US005253784A

United States Patent [19]

Kossel

[11] Patent Number: 5,253,784

[45] Date of Patent: Oct. 19, 1993

[54] METHOD AND APPARATUS FOR THE DISPENSING OF GAME BOARD CHIPS

[76] Inventor: Gary Kossel, R.D. #1, Box 230-C, Bentleyville, Pa. 15314

[21] Appl. No.: 849,877

[22] Filed: Mar. 12, 1992

[51] Int. Cl.[5] ..... B65G 59/06

[52] U.S. Cl. ..... 221/267; 221/270; 221/281; 273/240

[58] Field of Search ..... 221/155, 312 A, 28, 221/185, 200, 202, 204, 267, 268, 269, 270, 281; 273/236, 240, 269

[56] References Cited

U.S. PATENT DOCUMENTS

| | | | |
|---|---|---|---|
| 2,718,299 | 9/1955 | Atwater et al. | 221/267 X |
| 2,885,110 | 5/1959 | Tregilgas | 221/185 X |
| 2,893,599 | 7/1959 | kay | 221/281 X |
| 2,919,510 | 1/1960 | Guilford | 221/200 X |
| 3,435,833 | 4/1969 | Tonaka | 221/155 |
| 3,436,163 | 4/1969 | Calabrese et al. | 273/240 X |
| 3,851,656 | 12/1974 | Haas et al. | 221/281 |
| 4,113,143 | 9/1978 | Spagnola, Jr. | 221/267 |
| 4,174,048 | 11/1979 | Volpe, Jr. | 221/267 |
| 4,675,973 | 6/1987 | Siu . | |

OTHER PUBLICATIONS

Kwik Chip Advertisement.

*Primary Examiner*—Robert P. Olszewski
*Assistant Examiner*—Dean A. Reichard
*Attorney, Agent, or Firm*—Lawrence R. Burns

[57] ABSTRACT

A tube and plunger assembly for dispensing disc shaped game chips to a game board. The tube is elongate and cylindrical in nature and has opposing ends, with one end for loading the chips into the tube and the other end for dispensing the chips individually to a game board. The end that receives the game chips has a funnel to aid in loading and aligning the chips along the longitudinal central axis inside of the tube. The other opposing end of the tube has a resilient chip interference on the inside diameter and close to the end of the tube, and the tube terminates in a game board abutment surface. A slot is formed having a first portion extending axially along the longitudinal center line of the tube and intermediate the opposing ends and a second slot portion extending radially outwardly from the center line of the tube, with the second portion located on the receiving end of the tube. A movable plunger is mounted in the slot and has means extending beyond the perimeter of the cylindrical tube for reciprocally moving the plunger along the length of the slot. The plunger has two positions, one position in the first portion of the slot along the axial center line of the tube so that it can contact one end of the stack of chips in the cylindrical tube, and a second position in the second portion of the slot where it is out of the way of the axial center line of the tube so that chips may be loaded in the tube.

11 Claims, 2 Drawing Sheets

METHOD AND APPARATUS FOR THE DISPENSING OF GAME BOARD CHIPS

BACKGROUND OF THE INVENTION

This invention has to do with game board dispensing chips and is especially concerned with a bingo dispenser for dispensing bingo chips onto a bingo board.

Playing Bingo is a big recreation across the country and organized games are held practically every night. The organized games usually can consist of ten to hundreds of people in a bingo hall with each person playing multiple boards. When a person desires to play multiple boards, it is imperative that a bingo chip be placed quickly and correctly upon the number of the board designated by the caller, and afterwards, the chips may be effectively collected from each board so that a new game may be started. The chips used are usually round disc-shaped pieces that lay flat on the board. An extremely popular disc-shaped chip is a magnetic bingo chip described by the U.S. Pat. No. 4,675,973, granted to Yuen Siu on Jun. 30, 1987. With this invention, the chips may be collected from the boards by waving a magnetic wand over the board, and a new game may be started. This invention has to do with the quick placing of these chips, or other non-magnetic chips on the board.

OBJECTS OF THE INVENTION

It is an object of the present invention to provide a quick and efficient method of dispensing a bingo chip to a game board.

It is an object of the present invention to provide a dispenser for holding multiple chips and repeatedly dispensing single chips to a game board.

It is an object of the present invention to provide an apparatus for storing numerous bingo chips and dispersing them one at a time to a game board.

It is a further object of the present invention to provide an apparatus that may be operated by one hand to dispense bingo chips to a game board.

It is a further object of the present invention to provide an apparatus that will dispense a single bingo chip to a game board by pressure contact with a game board.

It is a still further object of the present invention to provide a dispenser that can be quickly loaded with numerous chips and can quickly dispense the chips one at a time to a game board.

It is a still further object of the present invention to provide a chip dispenser where the supply of chips left in the dispenser can be easily ascertained.

BRIEF SUMMARY OF THE INVENTION

According to the present invention, there is provided a game board chip dispenser, especially a bingo chip dispenser which comprises an elongate substantially cylindrical tube for receiving and storing cylindrical game chips. The cylindrical tube has open opposing ends, with one of the opposing ends for receiving chips to be stacked into the tube, and the other opposing end for dispensing the stacked chips from the tube one at a time. On the opposing end that receives the game chips, a funnel is provided to receive and align the chips so that they will easily stack into the tube. Intermediate of the opposing ends, an axial slot is formed in the side walls of the tube for receiving a movable plunger in the slot. The slot has two portions with the first portion extending between the opposing ends along the axial center line of the tube and a second portion extending radially outwardly from the axial center line of the tube near the chip receiving end of the tube. The movable plunger is movable along the axial center line of the cylindrical tube, and has finger means extending from the plunger to outside the perimeter of the tube, so that a persons fingers may act on the finger means to move the plunger along the axial center line of the tube. On the opposing end of the cylindrical tube that dispenses the chips from the tube is provided a board abutment surface, and it is located on the lowermost end of the tube. A resilient interference means is provided on the inside diameter of the tube near the abutment end of the tube so that the stacked chips in the cylindrical tube will be held therein until the tube is contacted with the board and the plunger is pushed towards the board. When the plunger is pushed towards the board, the resilient interference means allows a single chip to be dispensed through the end of the tube and to rest on the game board.

DETAILED DESCRIPTION OF THE DRAWINGS

Figure 1:
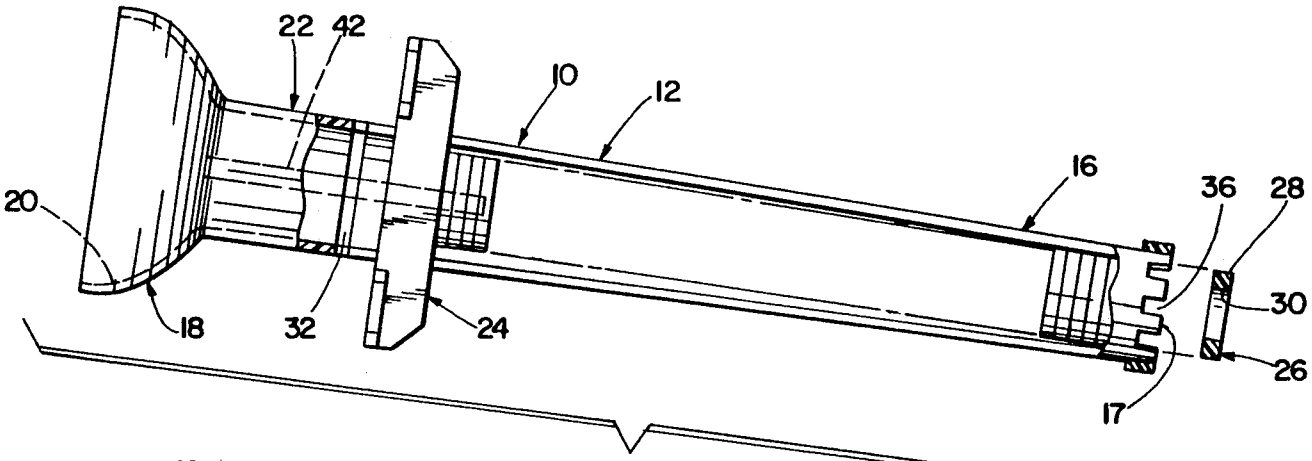
FIG. 1 is a perspective view of a Bingo Dispenser Assembly according to the present invention.

What is shown in FIG. 1 is a game board chip dispensing assembly 10, having a tube 12 with opposing ends 14, and 16. Upper end 14 is attached to a funnel means 18 which has an upper end 20 designed to receive game board chips and funnel them into a lower neck portion 22 so that they may be aligned and stacked as they enter the upper end 14 of the tube 12. An axial slot 21, (Shown in FIG. 2) is formed intermediate the ends 14 and 16 of the tube 12, and a plunger 24 is movably mounted in that slot so that it may contact and abut the upper end of the stack of chips 26 that are mounted in the tube 12. Chips 26 are formed of a ferro-magnetic ring 28, housed in a clear plastic material 30, such that they are a solid disk like chip, although this invention may be used for non-magnetic bingo chips also. The upper part of tube 14 is fastened to a neck 32 of the funnel means 18 by a close fitting interference fit of the inside diameter of the upper ring 14 of the tube 12. Glue means may be used to hold the funnel and tube together, although it would be preferred to form them as one piece. The inside diameter of the tube 12 is tapered from being the greatest at the upper end 14, to an interference fit with the diameter of the chips near the lower end 16. Slots 36 are formed at the dispenser end 16 to aid in dispensing of the chip from tube 12 to a game board.

Figure 2:
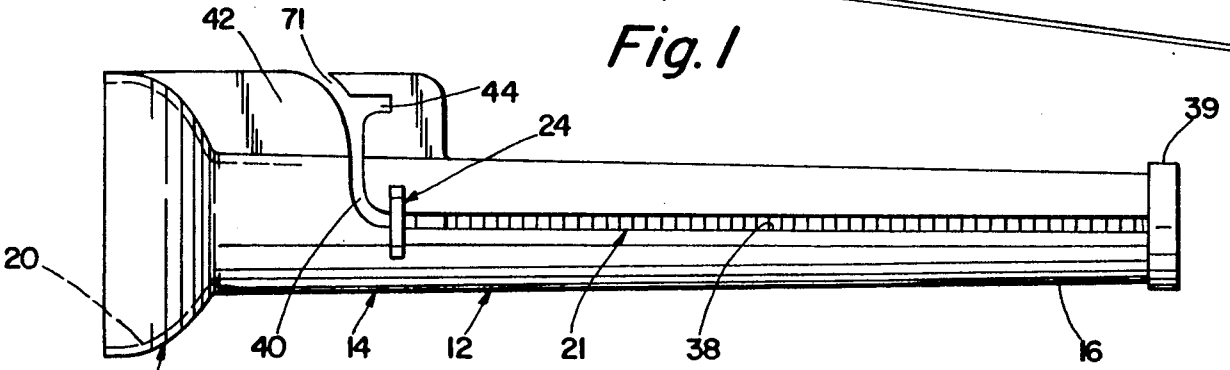
FIG. 2 is a cut away side view of a Bingo Dispenser Assembly according to the present invention.

Shown in FIG. 2 is a fuller description of the tube 12, having an upper end 14 and a lower end 16 and shown with the axial slot 21 formed therein. The axial slot 21 has a first portion 38 that extends up past the upper end of the tube 14 and joins a further slot 40 that extends laterally outward from the diametrical center line of the tube 12. The axial slot 40 joins another slot 44 that is formed downwardly in the tube 42 so as to have a rest position for the plunger mechanism 24 when the chips 26 are being loaded into the funnel means 18. On the lower end 16 of the tube 12, a reinforcing band 39, preferably of expandable plastic or rubber is shown surrounding slots 36. The diameter of the step 52 will be greater than the chip 26 and the slots 36, of course, will extend up into the lower wall 50 to a height greater than step 52 so as to provide a resilient interference fit of the lower end 16 of the tube 12.

Figure 3:
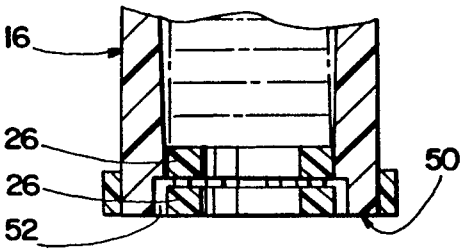
FIG. 3 is a blown up, cross sectional view of the lower end 16 of the tube 12, according to the present invention.

What is shown in FIG. 3 is a lower end 16 of the tube member 12, having two chips 26, shown stacked therein, with the lower edge members 50 of the lower end 16 having a step 52 formed therein so that when a chip is forced downward and out of the interference fit with the tube diameter, the edges of the dispensed chip are in the step 52 and the chip will thereby be released from the tube 12, so as to rest upon the game board. The height of the step will be determined by the thickness of the bingo chip to be dispensed and will be just slightly more than the chip thickness.

Figure 4:
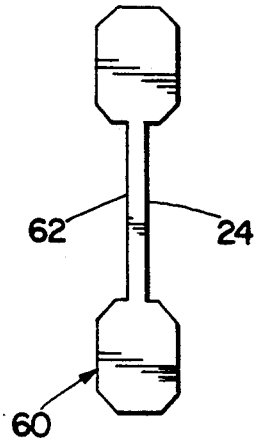
FIG. 4 is a plan view of a plunger member according to the present invention.
Figure 5:
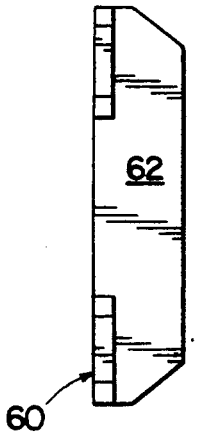
FIG. 5 is a side view of the plunger member according to the present invention.

What is shown in FIGS. 4 and 5 is a plan view and side view respectively of the plunger mechanism 24 having ends 60 that are finger contact areas so as to press downward on the plunger, and an intermediate section 62, which is designed to fit through slots 38 and 40 and fit into slot 44. When it is desired to load more chips into the tube 12, the plunger 24 may be raised up into the portion 40 and turned so that faces 60 are pointing towards the dispensing end of the tube, and intermediate section 62 will then be resting in slot 44. The height of the intermediate section 62 (shown further in FIG. 5) is such that 62 may sit into slots 44 and remain out of the way as chips are loaded down the upper end 14 of the tube 12. Shown further by this example, is FIG. 2 showing the plunger 24 resting in its upside down position in the slot 44.

Figure 6:
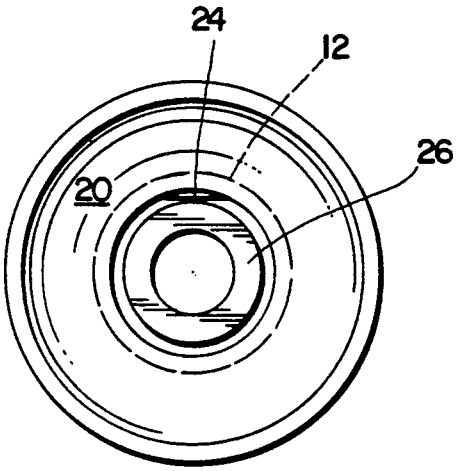
FIG. 6 is a plan view of the Bingo Chip Dispenser according to the present invention.

Shown in FIG. 6 is a plan view of the funnel assembly 18 showing the inlet area 20. As can be seen looking down the axial length of the tube 12, the chip 26 at the top of the stack is shown having clearance on the sides of its outer diameter with that portion in tube 12. Since the tube 12 is tapered, there is excess clearance between the chip diameter and the inside diameter of the tube 12. This excess clearance allows the plunger 24 to be moved over and turned upside down in slot 44, such that the chips 26 may still have sufficient clearance to pass through the funnel 18 and to axially stack in the tube 12.

The plunger mechanism 24 in this alternate embodiment without re-enforcer body 42, is placed into the tube 12 by holding the plunger 24 so that the faces 60 are pointed upward and the intermediate section 62 is slipped into the opening 71. When this is done the plunger body 62 may be slid in an upright position all the way in position 38 of the slot 21. When it is desired to load more chips into the tube 12, the plunger 24 may be raised up into the portion 40 and turned so that faces 60 are pointing towards the dispensing end of the tube 16, and intermediate section 62 will then be restored in slot 44. Slot position 44 should have a greater height along the axial length of tube 12, then the intermediate section 62 of plunger 24.

Figure 7:
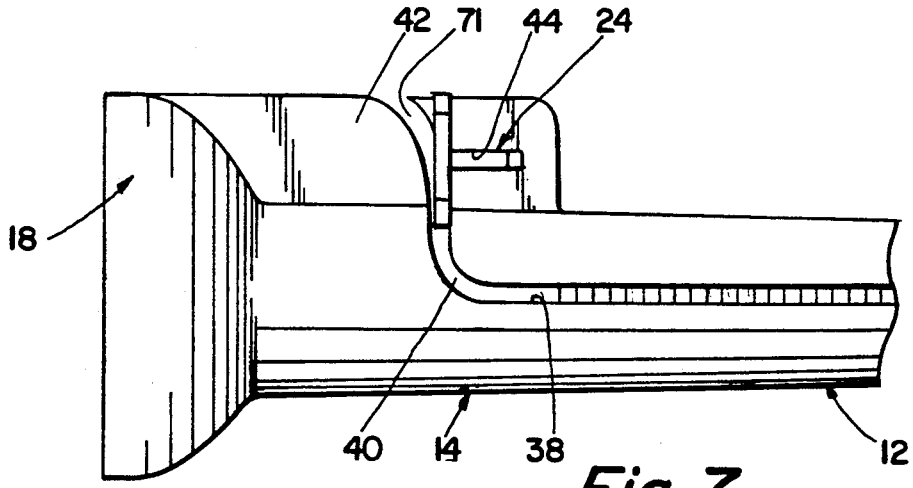
FIG. 7 is another embodiment of the dispenser according to the present invention.

Shown in FIG. 7 is an alternate embodiment of the present invention having a tube 12 with an upper end 14 and a lower end 16 and showing it with the axial slot 38 formed therein. The axial slot 38 extends up past the upper end of the tube 14 and joins a further slot 40 that extends laterally outward from the diametrical center line of the tube 12 until it reaches the outside of the body 42 formed in conjunction with the funnel means 18, on the assembly 10. The axial slot 40 joins another slot 44 that is formed downwardly in the body 42 so as to have a rest position for the plunger mechanism 24 when the chips 26 are being loaded into the funnel means 18. On the lower end 16 of the tube 12, again the slots 36 are shown formed in the bottom thereof to aid in dispensing the chips. This feature is shown more clearly in FIG. 3.

When the chip 26 has a diameter of ¾ of an inch it is preferable that the funnel have a ⅞ I.D. inch opening at 22 going to the upper end 14 of tube 12. The upper end 14 will have a 15/16 inch I.D. and the slots 36 will provide a resilient interference fit inside diameter of 23/32 of an inch. The slots of course will expand outward when the plunger 24 presses downward on the stack of chips and expandable band 39 will expand to allow slot 36 to move outwardly and allow chips 36 to pass into the area created by steps 52.

I claim:

1. A game board chip dispenser which comprises:

a) an elongate tube for receiving and storing game board chips;

b) open opposing ends on said tube with one end for receiving chips into said tube, and the opposing end for dispensing chips from said tube;

c) funnel means on the receiving end of said tube for collecting and aiding alignment of said chips being placed into said tube;

d) an axial slot formed in said tube, intermediate of said opposing ends for receiving a movable plunger therein;

e) a plunger movably mounted in said slot, and having means thereon for moving said plunger said means extending outside a perimeter of said tube;

f) a board abutment surface located on said dispensing end of said tube;

g) means on said dispensing end of said tube for dispensing one chip each time said board abutment surface is in contact with said board and said plunger is pressed towards said board.

2. The game board chip dispenser according to claim 1 in which said means for dispensing said chip comprises the dispensing end of said tube having an inside diameter sized so as to have interference fit with the diameter of the chip to be dispensed, and means allowing said inside diameter to expand when said plunger exerts a force in the chip towards the board.

3. The game board chip dispenser according to claim 2 in which said means allowing said inside diameter to expand comprises slots formed through the peripheral wall of the tube and extending along the axial length of the tube.

4. The game board chip dispenser according to claim 2 in which said means for dispensing said chips further comprises the inside diameter of the tube being larger than the diameter of the chips from the board abutment surface to the interference diameter of the dispensing end.

5. The game board chip dispenser according to claim 4 in which the larger inside diameter extends the axial length of the tube in an amount greater than the width of the chip to be dispensed.

6. The game board dispenser according to claim 3 which further comprises a reinforcing ring along the outside diameter of the slotted portion of the tube.

7. The game board dispenser according to claim 1 in which said tube is comprised of a transparent material.

8. The game board dispenser according to claim 1 in which the inside diameter of the tube is larger at the receiving end than at the dispensing end.

9. The game board dispenser according to claim 8 in which the inside diameter of the tube near the dispensing end forms an interference fit with the diameter of the chip to be dispensed.

10. The method of dispensing chips to a game board which comprises the steps of:

a) loading a tube having opposing open ends with multiple chips to be dispensed so that said chips are stacked one on top of the other;

b) placing a plunger on one end of the stacked chips;

c) abutting the opposite end of the tube to said game board;

d) pressing said plunger so as to dispense one chip to said board.

11. The method of manufacturing a game board chip dispenser which comprises the steps of:

a) forming an elongate tube having one end for receiving game board chips and another end for dispensing said chips;

b), forming an axial slot intermediate of said ends, for moveably mounting a plunger therein;

c) attaching a funnel means to the receiving end of said tube so as to help collect and align chips that are to be stacked inside said tube;

d) providing means on the other end of said tube for abutting a game board;

e) providing means for allowing one chip to be dispensed to said board when the tube is in abutment with the board and downward pressure is placed on said stack of chips.

* * * * *